United States Patent [19]

Buchanen, III

[11] 4,375,729

[45] Mar. 8, 1983

[54] FOOTWEAR HAVING RETRACTABLE SPIKES

[76] Inventor: Wiley T. Buchanen, III, 1514 Blake St., Denver, Colo. 80202

[21] Appl. No.: 288,053

[22] Filed: Jul. 29, 1981

[51] Int. Cl.[3] ..... A43C 15/14; A43C 15/02

[52] U.S. Cl. ..... 36/61; 36/134; 36/127; 36/59 R

[58] Field of Search ..... 36/61, 134, 62, 59 R, 36/2.5 R, 127

[56] References Cited

U.S. PATENT DOCUMENTS 3,717,238 2/1973 Fox ..... 36/61
3,793,751 2/1974 Gordos ..... 36/164
4,271,608 6/1981 Tomuro ..... 36/61

*Primary Examiner*—Werner H. Schroeder
*Assistant Examiner*—Steve Meyers
*Attorney, Agent, or Firm*—Burgess, Ryan & Wayne

[57] ABSTRACT

Anti-skid spikes for use on shoes or boots, to provide firm footing on ice or snow. The spikes are readily extendable and retractable without the use of keys or tools, e.g., when entering a car or a house where floors and rugs might otherwise be damaged thereby. A mechanism for selectively extending and retracting the spikes is sealed within the sole and heel of the footwear to provide improved esthetics and to prevent interference with the mechanism, as by moisture and ice, when temperatures vary from hot to cold.

11 Claims, 8 Drawing Figures

FOOTWEAR HAVING RETRACTABLE SPIKES

BACKGROUND OF THE INVENTION

This invention relates to footwear having retractable spikes.

Structures of this type are generally known in the art, as exemplified by the following U.S. Pat. Nos. 3,717,238; 3,747,238; 3,631,614; 2,331,609; 2,776,499; 3,343,283; 3,793,751; 1,179,652; 1,433,660; 2,022,655; 2,920,404.

Of these, U.S. Pat. Nos. 3,717,238 and 3,793,751 show the use of eccentric mechanisms to cause the sole spikes to protrude, and the former patent incorporates spring elements. U.S. Pat. No. 3,343,283 shows the use of a key to extend the spikes. Other patents show structures which could be clamped onto a shoe or boot.

None of these prior art arrangements, however, shows or suggests a structure wherein the spikes are sealed entirely inside a footwear sole that may be permanently secured to shoes and boots, and may be extended and retracted without unsightly external keys, levers or other projections.

Many snow and ice gripping spikes and cleats have been devised to be tied or clamped onto footwear. Other spikes and cleats have been built into footwear, but these require keys or external levers to extend or retract the spikes or cleats, and no thought has been given to keeping water, ice and snow out of the mechanism. These previous arrangements have the inherent problems of where to store the attachments when they are not in use, the discomfort of handling the attachments in cold and snowy weather, the problems of finding the keys, and the problems of manipulating the ties, clamps and levers when they are covered with ice and snow.

Accordingly, an object of the present invention is to provide, for footwear, retractable spikes that are effective when extended and that do not detract from the appearance of the shoe when the spikes are withdrawn.

Another object of the invention is to provide a mechanism for controlling retractable spikes, which mechanism may be completely hidden inside the sole of a shoe.

SUMMARY

As herein described, there is provided a sole structure for a shoe which has a cam member for urging spikes from a retracted position to an extended position. The mechanism for moving the cam member to extend and retract the spikes is contained within the structure and may be manipulated by finger pressure, through a flexible wall portion thereof.

According to another feature of the invention, the cam member is coupled to a sealed spring urged mechanism that may be manually cocked to withdraw anti-skid spikes and may be manually unlatched to extend the spikes.

IN THE DRAWING

Figure 5B:
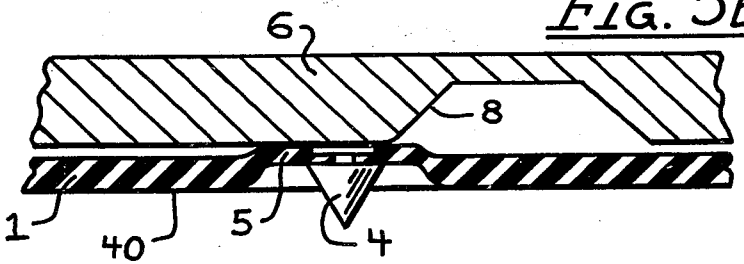
Figure 5A:
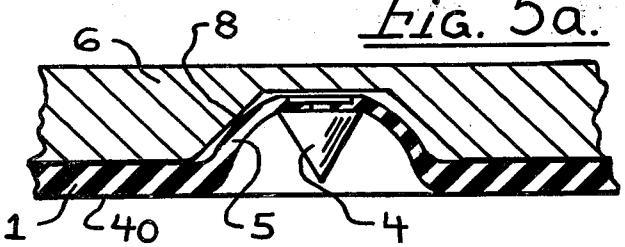
Figure 6B:
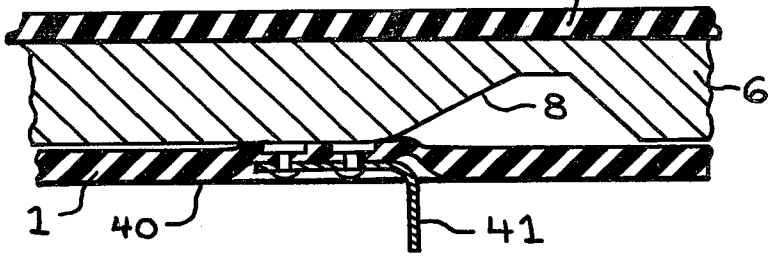
Figure 6A:
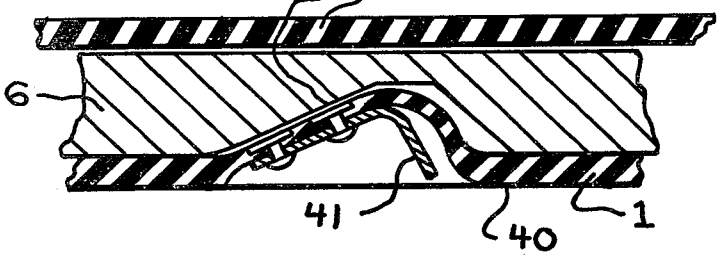

FIGS. 5*a* and 5*b* show the detail of the interaction between a spike and the cam member; and FIGS. 6*a* and 6*b* show the detail of said interaction according to an alternative embodiment of the invention.

DETAILED DESCRIPTION

A sole 1 (FIG. 1) has a tread surface 40, including an integral heel portion 2, and is secured to an intermediate sole 3, as by cementing or vulcanizing, to create a waterproof seal therebetween. The intermediate sole 3 may be attached to or may be an integral part of a shoe or boot. The intermediate sole 3 may be attached to the shoe or boot in any known manner, without departing from the spirit of the invention.

The sole 1, heel portion 2 and intermediate sole 3 comprise a hollow member and may be formed of any suitable material that is flexible, long wearing and waterproof, such as synthetic rubber or plastic.

Spikes 4 are secured in the sole 1 and heel portion 2 in such a manner as to form a waterproof seal between the spikes 4 and sole 1, including its heel portion 2. The spikes 4 are situated in and vulcanized or otherwise secured to flexible recesses or dimples 5, which normally hold the spikes 4 in retracted positions, as shown; and have a thickness substantially less than that of the sole 1.

The term "spikes" as herein employed is intended to include cleats and other ground-engaging protuberances.

Figure 1:
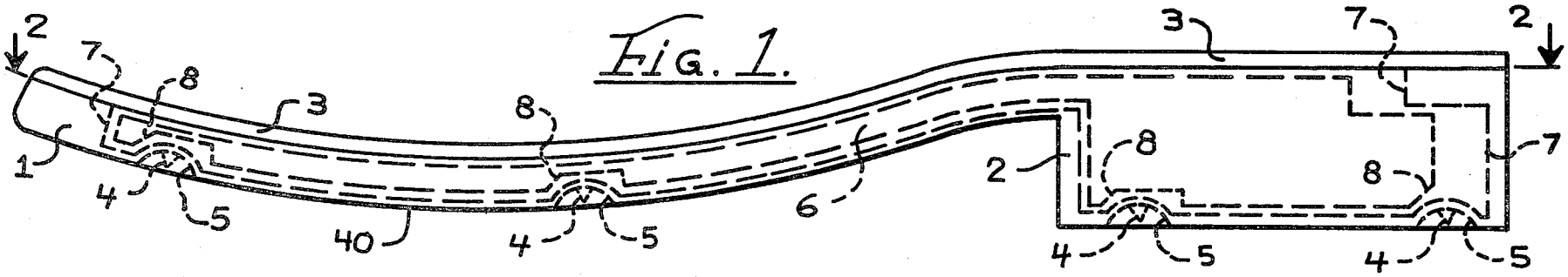
FIG. 1 is a side view of a sole and heel according to a preferred embodiment of the invention, that may be attached to a shoe or boot, showing ground gripping spikes in retracted position.

A sliding cam member 6 is confined in a sealed cavity 7, which is formed in the sole 1 and its heel portion 2 (to keep out water and foreign matter), and the cam member 6 is sealed therein by the attachment of the intermediate sole 3 to the sole 1. The cam member 6 may be slid leftward or forward (FIG. 5*a*), from the position shown in FIG. 2, by means to be described presently, for causing cam surface portions 8 (FIG. 1) to release the spikes 4 while the dimples flex to withdraw the spikes 4, as shown in FIG. 1. The cam member 6 may be slid rightward or rearward (FIG. 5*b*), from the position shown in FIG. 1, for causing cam surface portions 8 to extend the spikes 4, while the dimples yield to permit extension of the spikes 4.

The sliding cam member 6 may be made of any tough flexible material (preferably having a low friction surface), dimensioned so as not to buckle under longitudinal compressive stress, such as steel or polytetrafluoroethylene, that will provide long lasting cam surface portions 8 (FIG. 1), while yielding to bending of the sole 1 in the normal use of the shoe or boot.

Figure 2:
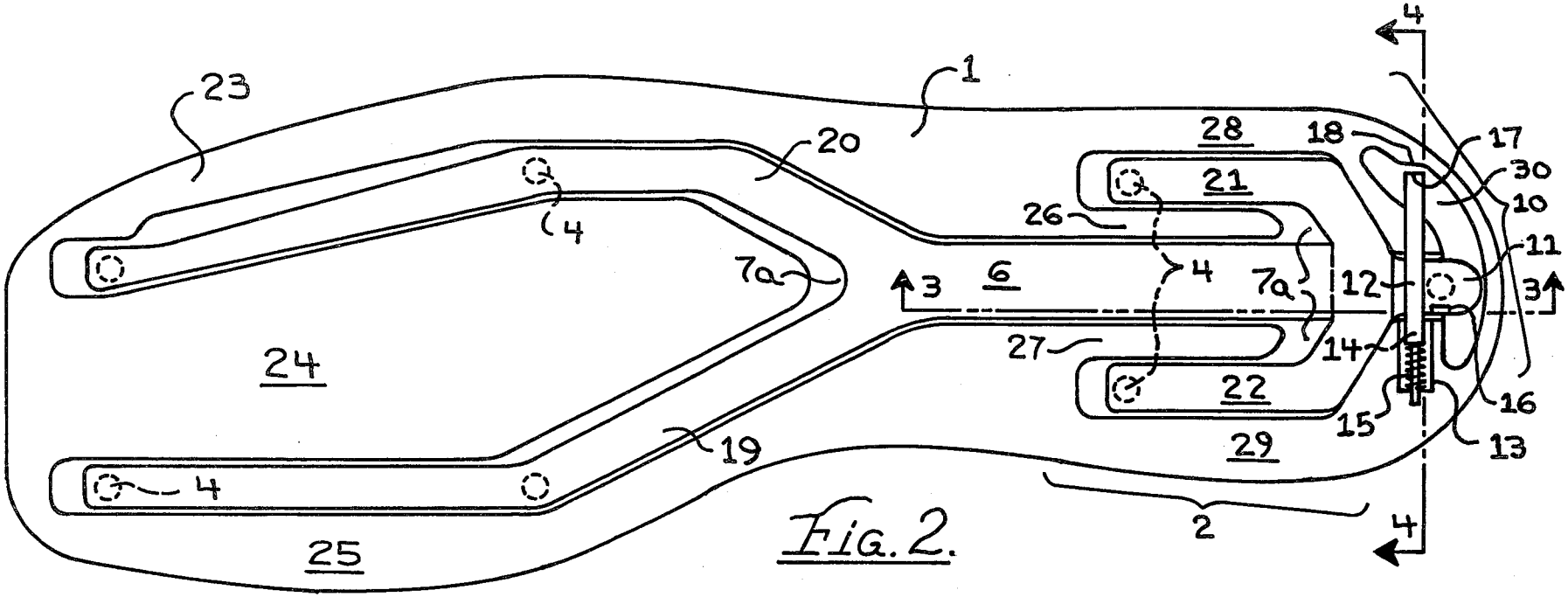
FIG. 2 is a sectional top plan view, taken on line 2—2 of FIG. 1, showing the sliding cam member in position for controlling the spikes to be extended.
Figure 3:
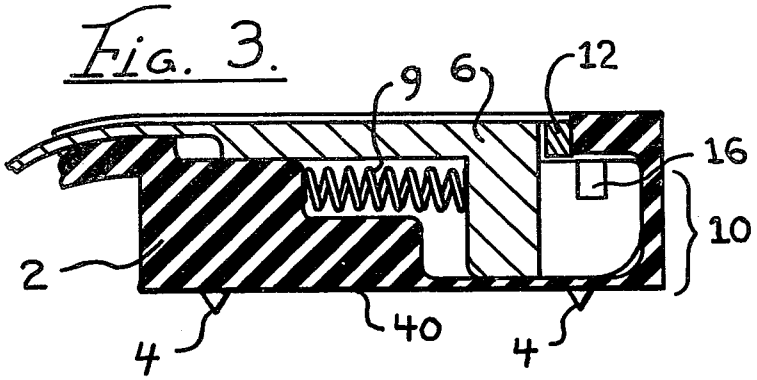
FIG. 3 is a fragmentary sectional view, taken on line 3—3 of FIG. 2, showing the sliding cam member in spike extending position and a spring for shifting the sliding cam member to extend the spikes.

FIGS. 2 and 5*b* show the cam member 6 in the rearward position which it assumes for extending the spikes 4 (FIG. 1). An expansive coil spring 9 (FIG. 3) is provided for shifting the cam member 6 rearward, or rightward as shown here, where the spikes 4 are extended by the cam member 6.

Typically, the spikes 4 may extend about $\frac{1}{8}$ inch beyond the tread surface 40.

Larger spike extensions may be obtained by utilizing L-shaped spikes 41, one leg thereof secured to the cam following portions of the corresponding recesses, as shown in FIGS. 6*a* and 6*b*, so that the spikes 41 rotate from an initial retracted position (FIG. 6*a*) in which the cleat-like leg is generally elevated above the tread surface 40, to an extended position wherein the cleat-like leg is substantially perpendicular thereto (FIG. 6*b*), when the cam member 6 is moved rearward.

A thin wall section 10 of heel portion 2 (FIG. 2) is sufficiently flexible or yieldable to permit finger pressure against it to move extension 11 and the cam member 6 forward. This allows spikes 4 (FIG. 1) to withdraw to their retracted position.

A slide member 12 (FIGS. 2 and 4) is situated transversely, in a supporting molded slot 13, in heel portion 2, for permitting transverse slide movement of the slide member 12.

Figure 4:
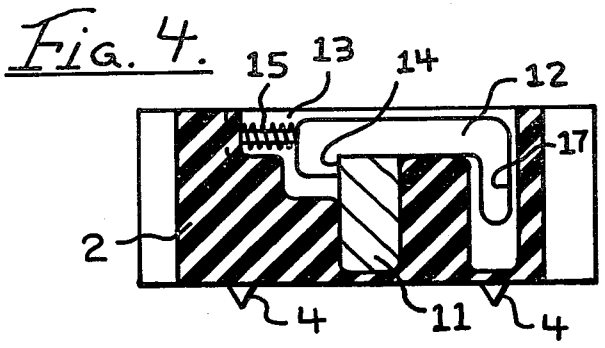
FIG. 4 is a sectional rear view, taken on line 4—4 of FIG. 2, showing the slide/latch member that is used to hold the sliding cam member in a forward position for permitting the spikes to be withdrawn.

The slide member 12 has a depending latch portion 14, that is urged against the extension 11 by a spring 15 as best shown in FIG. 4. When the extension 11 and cam member 6 are moved leftward (forward) from the position of FIG. 2, a notch 16 in the extension 11 is moved into registration with the latch portion 14 (FIG. 4), and the slide member 12 is moved rightward under tension of spring 15; and its latch portion 14 is moved into notch 16 (FIG. 2) for holding the cam member 6 forward against tension of spring 9 (FIG. 3), in which position spikes 4 (FIG. 1) are withdrawn to their retracted position.

When it is desired to extend the spikes 4 (FIG. 1), finger pressure against the outside wall section 10 (FIG. 2) and against an end portion 17 of slide 12, in the area of wall portion 18 moves the slide member 12, against the tension of relatively light spring 15, for disengaging the latch portion 14 (FIG. 4) from the notch 16 (FIG. 2), thereby releasing the extension 11 and cam member 6.

When the extension 11 and cam member 6 are thus released, the influence of heavier spring 9 (FIG. 3) slides the cam member 6 rearward, whereupon the cam surfaces 8 (FIG. 1) move the spike 4 into extended position for gripping the surface on which the wearer may tread.

The cam member 6 may have branches 19 and 20 (FIG. 2) for operating the spikes 4 located in desired locations under the ball and toe of the foot. Similarly, branches 21 and 22 may be provided on the cam member 6 for operating spikes 4 located in desired locations on the bottom of the heel.

To maintain sufficient top and bottom clearance for cam member 6, between bottom 7*a* of cavity 7 and the intermediate sole 3 (FIG. 1), load bearing portions 23, 24, 25, 26, 27, 28 and 29 (FIG. 2) of the sole 1 are provided to support the intermediate sole 3 and the weight of the wearer.

Space 30 is provided between the wall section 10 and the load bearing portions 28 and 29 to permit movement of the wall section 10 against the extension 11 and against the end portion 17 of the slide member 12.

Thus, the mechanism required for extending and retracting the spikes is primarily comprised of only two moving parts, viz. cam member 6 and slide member 12, and these parts are sealed in cavity 7 and space 30 for protection thereof from dirt, water, snow, ice, etc.; and clearance for operation of the moving parts is maintained.

I claim:

1. Footwear having retractable spikes, comprising:

an elongated hollow member including a sole having a tread surface with a plurality of resilient normally recessed parts therein;

a corresponding plurality of spikes secured to respective ones of said normally recessed parts, each spike having a length such that it does not normally extend beyond said tread surface;

a slidably movable cam member disposed within said hollow member adjacent said sole and having a corresponding plurality of cam surface portions for (i) permitting said normally recessed parts of said sole to remain in a retracted position wherein said spikes do not extend beyond said tread surface, when said cam member is in a first longitudinal position, and (ii) urging said normally recessed parts toward said tread surface to cause said spikes to extend therefrom when said cam member is in a second longitudinal position; and actuating means disposed within said hollow member and operable via a flexible wall portion thereof, for moving said cam member between said first and second positions thereof.

2. The footwear according to claim 1, wherein the thickness of said normally recessed parts of said sole is substantially less than the thickness of adjacent portions of said sole.

3. The footwear according to claim 1, wherein said hollow member is sealed to keep out water and foreign matter.

4. The footwear according to claim 1 wherein said actuating means includes a spring means for urging said cam member from said first position to said second position.

5. The footwear according to claim 4, wherein said actuating means includes latch means for holding said cam member in said first position, against the tension of said spring means, said latch means being shiftable to release said cam member, whereby said spring means shifts said cam member to said second position to extend said spikes.

6. The footwear according to claim 1, wherein at least some of said spikes are L-shaped, with one leg of each L-shaped spike secured to an inwardly inclined portion of the corresponding normally recessed part, so that the other leg thereof rotates from an initial retracted position to an extended position when said cam member is moved from said first position to said second position.

7. Retractable anti-skid spikes for footwear, comprising a sole including a flexible tread and spikes in said tread, said tread normally holding said spikes up in ineffective positions, said sole comprising a cavity containing a cam member shiftable from a first position to a second position for flexing said tread to extend said spikes in effective ground gripping positions.

8. The combination according to claim 7, wherein said cavity is hermetically sealed for keeping out foreign matter, and for thereby protecting said cam member and protecting space for the cam member to shift.

9. The combination according to claim 7, and comprising a spring for shifting said cam member into said second position for flexing said tread and extending said spikes in effective ground gripping position.

10. The combination according to claim 9, wherein said cam member is shiftable from said second position to said first position, against the tension of said spring, for permitting reflexing of said tread and for thereby returning said spikes to normal ineffective positions.

11. The combination according to claim 10, and comprising a latch means for holding said cam member in said first position, against the tension of said spring, said latch means being shiftable to release said cam member, whereby said spring shifts said cam member to said second position for flexing said tread and extending said spikes.

* * * * *

UNITED STATES PATENT AND TRADEMARK OFFICE

CERTIFICATE OF CORRECTION

PATENT NO. : 4,375,729

DATED : March 8, 1983

INVENTOR(S) : Wiley T. Buchanan, III

It is certified that error appears in the above-identified patent and that said Letters Patent is hereby corrected as shown below:

The inventor's name should be --Wiley T. Buchanan, III--

The inventor's address should read as follows:

--1100 New Hampshire Avenue, NW
Washington, D.C. 20037--

Signed and Sealed this

*Nineteenth* Day of *March 1985*

[SEAL]

*Attest:*

DONALD J. QUIGG

*Attesting Officer* *Acting Commissioner of Patents and Trademarks*